US006739899B2

(12) United States Patent
Kuwayama et al.

(10) Patent No.: US 6,739,899 B2
(45) Date of Patent: May 25, 2004

(54) METHOD AND STRUCTURE FOR CONNECTING A TERMINAL WITH A WIRE

(75) Inventors: Yasumichi Kuwayama, Shizuoka (JP); Toshihiro Maki, Shizuoka (JP); Masanori Onuma, Shizuoka (JP); Nobuyuki Asakura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/183,048

(22) Filed: Jun. 27, 2002

(65) Prior Publication Data

US 2003/0022562 A1 Jan. 30, 2003

(30) Foreign Application Priority Data

Jul. 25, 2001 (JP) ..... P2001-223974
Aug. 27, 2001 (JP) ..... P2001-256720

(51) Int. Cl.[7] ..... H01R 4/24
(52) U.S. Cl. ..... 439/427
(58) Field of Search ..... 439/427, 877, 439/784

(56) References Cited

U.S. PATENT DOCUMENTS 1,247,656 A * 11/1917 Gadke ..... 439/427
3,673,313 A * 6/1972 Pickett et al. ..... 439/427
4,091,233 A * 5/1978 Berman ..... 439/427
5,851,124 A * 12/1998 Young et al. ..... 439/427

FOREIGN PATENT DOCUMENTS

| | | | |
|---|---|---|---|
| FR | 2005839 | * 12/1969 | ..... 439/427 |
| GB | 2086150 | * 5/1982 | ..... 439/427 |
| GB | 2 369 255 | 5/2002 | |
| GB | 2 371 418 | 7/2002 | |
| GB | 2 371 420 | 7/2002 | |
| IT | 571104 | * 12/1957 | ..... 439/427 |
| JP | 50-43746 | 12/1975 | |
| JP | 110185843 A | 7/1999 | |
| JP | 110265739 A | 9/1999 | |

* cited by examiner

*Primary Examiner*—Gary Paumen
(74) *Attorney, Agent, or Firm*—Sughrue Mion, PLLC

(57) ABSTRACT

In a method of connecting a terminal with a wire in which a core (2) of a wire is inserted into a tubular wire connecting portion (1) of a terminal, and the wire connecting portion is crimped in a radial direction of the wire, the wire connecting portion is compressed in a radial direction of the wire and uniformly over the whole circumference. While rotating dies (7') by using a rotary swaging machine, the wire connecting portion is compressed by the dies in a radial direction of the wire and uniformly over the whole circumference. The wire connecting portion is compressed in a radial direction of the wire and uniformly over the whole circumference, and the outer periphery of a compressed part of the wire connecting portion has a true circular section shape.

3 Claims, 16 Drawing Sheets

METHOD AND STRUCTURE FOR CONNECTING A TERMINAL WITH A WIRE

BACKGROUND OF THE INVENTION

The present invention relates to a method and structure for connecting a terminal with a wire in which a tubular wire connecting portion of a terminal is crimp-connected to a core of a wire in a uniform manner over the whole circumference by using, for example, a rotary swaging machine.

Conventionally, a wire is connected to a terminal by the following connecting method. As shown in FIGS. 21A and 14B, for example, a core 37 of a wire 35 is crimped by a pair of crimp pieces 34 which are erected from both sides of a bottom plate 36 of a terminal 33, and the paired crimp pieces 34 are crimpingly deformed into a substantially eyeglasses-like shape, whereby the core 37 is strongly pressed from both the sides and tip ends 34*a* of the crimp pieces 34 are caused to bite the middle area of the core 37. As a result, the contact between the core 37 and the crimp pieces 34 is attained. As shown in FIG. 21B, inside the crimp pieces 34, the diameter of the core 37 is reduced, and, in the front and rear end sides of the crimp pieces 34, the diameter of the core 37 is outward increased, so that the core 37 is crimped by the wedge function.

The connecting method using the pair of crimp pieces 34 is effective for the wire 35 of a small diameter. By contrast, for a wire of a large diameter such as a shielded wire through which a large current can be flown, the method has a problem in that the contact area between the crimp pieces 34 and the core is small and the electric resistance is easily increased.

Therefore, a terminal of a type in which a core is crimped equally in the circumferential direction is used for such a wire of a large diameter. As an example of a connecting method using such a terminal, FIG. 22 shows a method of connecting a terminal with a wire which is disclosed in Japanese Utility Model Publication No. 43746/1975.

In the connecting method, under a state where a core of a wire is inserted into a tubular wire connecting portion of a terminal, the tubular wire connecting portion is crimped into a hexagonal shape by a pair of upper and lower dies 21, to cause the core 23 to be closely contacted into the wire connecting portion 22. As shown in FIG. 23, each of the dies 21 has three pressing faces 24, and a center ridge 25 is formed on each of the pressing faces 24. As shown in FIG. 22, the ridges 25 radially press the centers of the outer faces of the hexagonal wire connecting portion 22 to enhance the contact performance between the core 23 of the wire and the wire connecting portion 22 of the terminal.

However, the conventional connecting method and the connecting structure using the method have a problem in that, as shown in FIG. 22, burrs 26 are easily produced between the upper and lower dies 21 and on both sides of the wire connecting portion 22, and a large manpower is required for removing the burrs 26. When the wire connecting portion 22 of the terminal is crimped by using the upper and lower dies 21, as shown in FIG. 24, the vertical crimp forces (internal stress) $P_1$ which are directed to the center of the core 23 largely act, and the crimp forces (internal stress) $P_2$ on the lateral portions tend to be reduced, thereby causing another problem in that a gap is easily formed on both sides of the wire connecting portion 22 and between the element wires of the core 23, or between the core 23 and the wire connecting portion 22. When such a gap is formed, the electric resistance is increased to produce the possibilities that the power transmission efficiency is lowered, and that the connecting portion is overheated.

FIG. 25 shows a mode of crimp-connection of a wire by using a method similar to that of FIG. 22. The ridges 25 of the dies 21 (FIG. 23) radially press a core 23' of a wire at six places as indicated by the arrows F. Therefore, the core 23' is deformed so as to have a tortoise-like section shape, and stress concentration (the chain lines 29 show the distribution of internal stress) occurs in regions of a wire connecting portion 22' of a terminal which are between recesses 27 due to the ridges 25 (FIG. 23), i.e., in the vicinities of convex portions 28, and the crimping on the core 23' becomes uneven in the circumferential direction. As a result, gaps (gaps between element wires) 30 are easily formed in the core 23', gaps 31 are easily formed also between: the core 23' and the wire connecting portion 22' of the terminal, and the wire connecting portion 22' tends to crack because of the stress concentration, thereby producing a problem in that the strength is reduced. When the gaps 30 and 31 are formed, the electric resistance is increased in the same manner as described above to produce the possibilities that the power transmission efficiency is lowered, and that the connecting portion is overheated. Moreover, there is a further possibility that the core 23' easily slips from the wire connecting portion 22'.

SUMMARY OF THE INVENTION

In view of the above-discussed problems, it is an object of the invention to provide a method and structure for connecting a terminal with a wire in which a tubular wire connecting portion of a terminal can be beautifully crimped to a wire with producing internal stress uniformly in the circumferential direction, and without producing burrs, gaps between element wires of a core of the wire, and between the core and the wire connecting portion of the terminal can be eliminated to enhance the reliability of the electrical connection between the terminal and the wire, and the mechanical strength of the connecting portion can be improved.

In order to solve the aforesaid object, the invention is characterized by having the following arrangement.

(1) A method of connecting a terminal with a wire comprising the steps of:
- inserting a core of the wire into a tubular wire connecting portion of the terminal; and
- crimping the wire connecting portion in a radial direction of the wire so that the wire connecting portion is compressed in the radial direction and uniformly over a whole circumference of the wire.

(2) The method according to (1), wherein the wire connecting portion is compressed by dies in the radial direction over the whole circumference while rotating the dies by using a rotary swaging machine.

(3) The method according to (1), wherein
- a protrusion is formed on an outer periphery of the wire connecting portion, and
- during circumferential crimping of the wire connecting portion, the protrusion is projected from an inner periphery of the wire connecting portion to bite the core.

(4) A structure for connecting a terminal with a wire wherein a core of the wire is inserted into a tubular wire connecting portion of the terminal, and the wire connecting portion is crimped in a radial direction of the wire so that the wire connecting portion is compressed in the radial direction and uniformly over a whole circumference of the wire and an outer periphery of a compressed part of the wire connecting portion has a true circular section shape.

(5) The structure according to (4), wherein a protrusion is formed on an outer periphery of the wire connecting portion, and the protrusion is projected from an inner periphery of the wire connecting portion to bite the core after the wire connecting portion is crimped.

(6) The structure according to (5), wherein the protrusion is an annular ridge or at least one projection.

(7) A terminal comprising:

a wire connecting portion including a wire insertion hole, the wire connecting portion being to be subjected to a circumferential crimping process; and a contact protrusion, for entering a core of a wire, elongating in, a longitudinal direction of a wire and disposed in the wire insertion hole.

(8) The terminal according to (7), wherein the contact protrusion is positioned at a center of the wire insertion hole.

(9) The terminal according to (7), wherein the contact protrusion has a columnar shape.

(10) The terminal according to (7), wherein the contact protrusion has an initial length which is substantially one third of a length of the wire insertion hole.

(11) A method of connecting a core of a wire with a terminal including a wire connecting portion including a wire insertion hole, and a contact protrusion elongating in a longitudinal direction of a wire and disposed in the wire insertion hole, the method comprising the steps of:

inserting the core into the wire insertion hole so that the contact protrusion enters the core; and crimping the wire connecting portion radially and uniformly over a whole circumference at the end by a circumferential crimping unit.

DETAILED DESCRIPTION OF PREFERRED EMBODIMENTS

Hereinafter, embodiments according to the invention will be described in detail with reference to the accompanying drawings.

First Embodiment

The method of connecting a terminal with a wire according to the invention is characterized in that, under a state where a core (conductor portion) of a wire is inserted into a tubular wire connecting portion of a terminal, a rotary swaging machine is used, and the wire connecting portion of the terminal is gradually radially compressed by dies which are rotated in the circumferential direction of the wire.

In the field of plastically processing a metal, a swaging process has been used. Formerly, a plastic deforming process is conducted by beating a workpiece with a hammer. From the viewpoints of the process efficiency, the process accuracy, the workability, the safety, and the like, the operation of deforming a workpiece by beating with a hammer is rationalized mechanically and physically in a swaging process.

Figure 1:
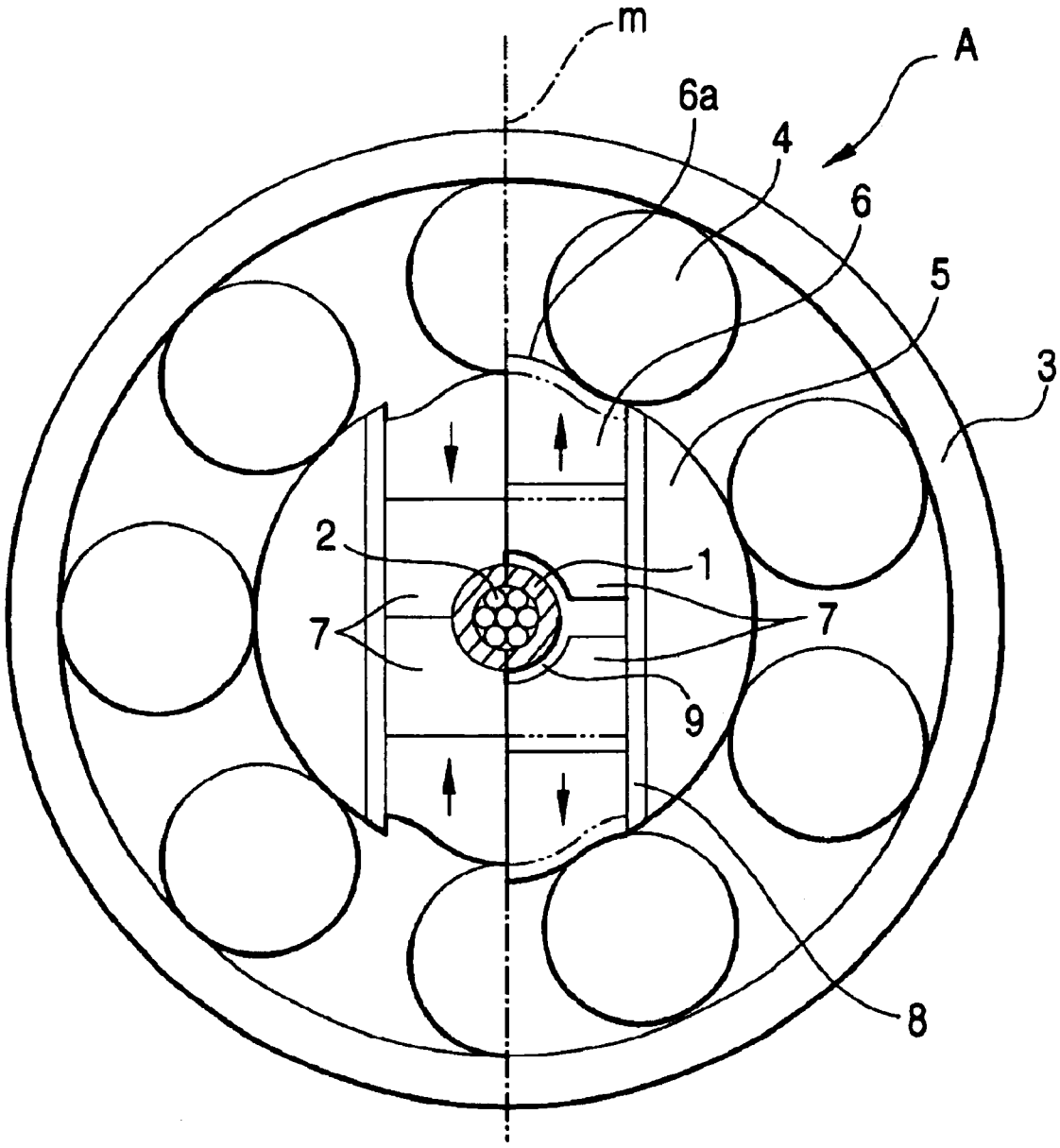
FIG. 1 is a front view (diagram) showing one mode of a processing section of a rotary swaging machine which is used in the method of connecting a terminal with a wire according to the invention.

FIG. 1 is a diagram showing one mode of a processing section A of a rotary swaging machine. The reference numeral 1 denotes a tubular wire connecting portion of a terminal, 2 denotes a core of a wire, 3 denotes a ring, 4 denotes rollers, 5 denotes a spindle, 6 denotes buckers (hammers), 7 denotes dies, and 8 denotes side liners. The right half of FIG. 1 with respect the vertical center line m shows an unpressed state (an opened state of the dies 7), and the left half shows a pressed state (a closed state of the dies 7).

The spindle 5 is rotated by a motor which is not shown in the figure. A pair of dies 7 are symmetrically arranged so as to be movable along the side liners 8 in a radial direction of the wire. A semicircular hole 9 into which the wire connecting portion 1 of the terminal is to be inserted is formed in the center of each of the dies 7. The dies 7 are fixed to the buckers 6 on the outer side, respectively. The buckers 6 are movable in a radial direction of the wire integrally with the respective dies 7. An outer peripheral face of each of the buckers 6 is configured as a ridge-like cam surface 6*a*. The dies 7 and the buckers 6 are rotated integrally with the spindle 5. The cam surfaces 6*a* of the buckers 6 are in contact with the outer peripheries of the rollers 4 on the outer side, respectively. A plurality of rollers 4 are arranged at a regular pitch between the spindle 5 and the ring 3, and rotatably contacted with the cam surfaces 6*a*, the outer peripheral face of the spindle 5, and the inner peripheral face of the ring 3.

When the spindle 5 is rotated by the motor (not shown), the dies 7 and the buckers 6 are integrally rotated, and the cam surfaces 6*a* of the buckers 6 are in sliding contact with the outer peripheries of the rollers 4, respectively. When the tops of the cam surfaces 6*a* are in contact with the roller 4, the pair of dies 7 are closed. When the base portions of the cam surfaces 6*a* are in contact with the rollers 4 while the buckers 6 and the dies 7 are outward moved by a centrifugal force, the pair of dies 7 are opened. In this way, the pair of dies 7 are opened and closed while being rotated.

When the dies 7 are closed, as shown in the left half of FIG. 1, the wire connecting portion 1 is beaten by the inner peripheral faces of the holes 9 of the dies 7 to be radially compressed. When the dies 7 are opened, as shown in the right half of FIG. 1, a gap is formed between the inner peripheral faces of the holes 9 of the dies 7 and the outer peripheral face of the wire connecting portion 1 of the terminal. In accordance with the rotation of the dies 7, the terminal and the wire are somewhat rotated in the same direction. As a result of repetition of the rotation, opening, and closing of the dies 7, the core 2 of the wire is crimped into a substantially true circular shape by the wire connecting portion 1 of the terminal.

Since the wire connecting portion 1 is radially compressed while the dies 7 are rotated with respect to the terminal, burrs are not produced in the wire connecting portion 1 unlike the case of the conventional art (FIG. 10), and the outer peripheral face of the wire connecting portion 1 is beautifully formed. Furthermore, the wire connecting portion 1 is crimped by a force which is uniform in the circumferential direction, so that the internal stress of the core 2 and the wire connecting portion 1 is uniformalized. As a result, formation of a gap between the element wires constituting the core 2, and between the core 2 and the wire connecting portion 1 is prevented from occurring.

Figure 2A:
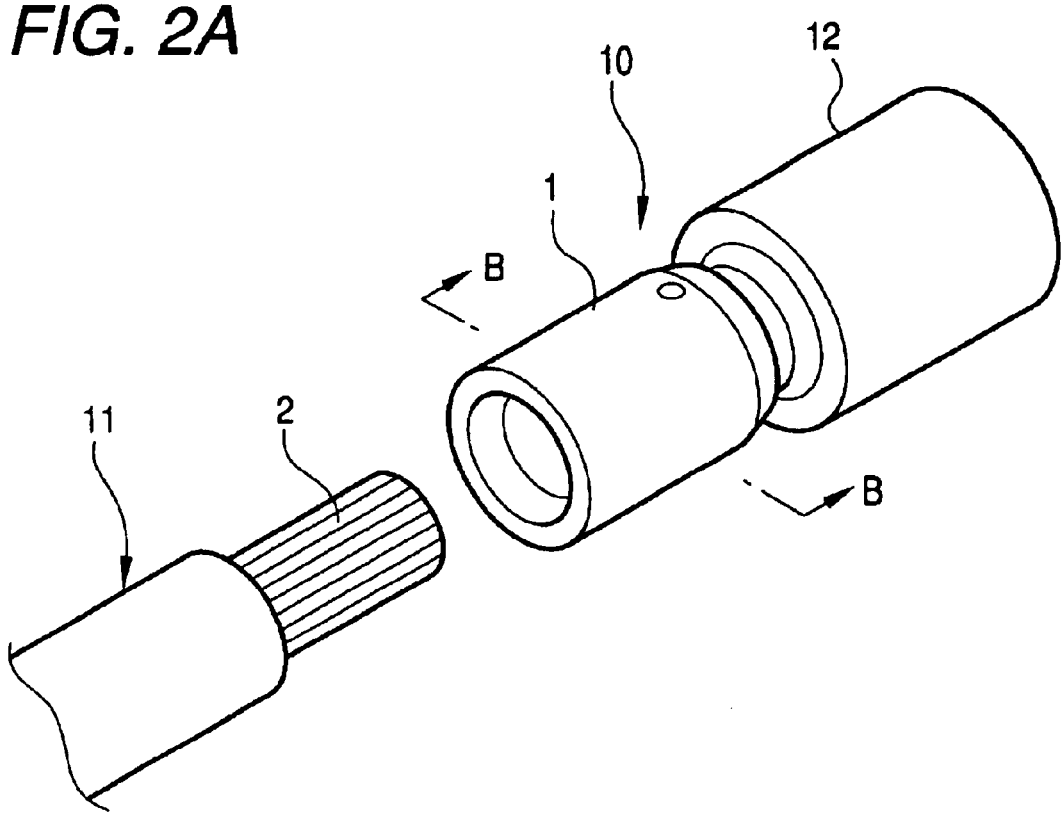
FIGS. 2A and 2B are perspective views showing states of a terminal and a wire before and after crimping, respectively.
Figure 2B:
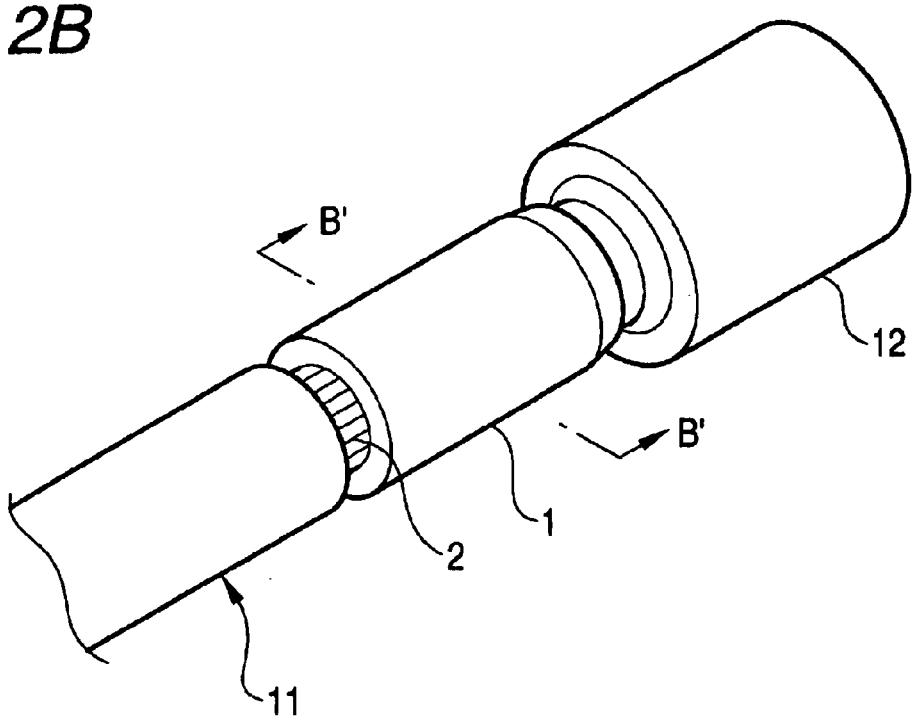

FIGS. 2A and 2B show states before and after a terminal 10 is crimp-connected to a wire 11, respectively. As shown in FIG. 2A, the terminal 10 has a tubular mating terminal connecting portion 12 in one side, and the tubular wire connecting portion 1 in the other side. The core 2 of the wire 11 is inserted into the wire connecting portion 1 of the terminal 10. While rotating the dies 7 in the swaging machine of FIG. 1, the wire connecting portion 1 of the terminal 10 is radially crimped to be uniformly connected to the wire 11 as shown in FIG. 2B. While elongating in the longitudinal direction, the wire connecting portion 1 is radially contracted. The compressed part of the wire connecting portion 1 has a true circular section shape.

Figure 3A:
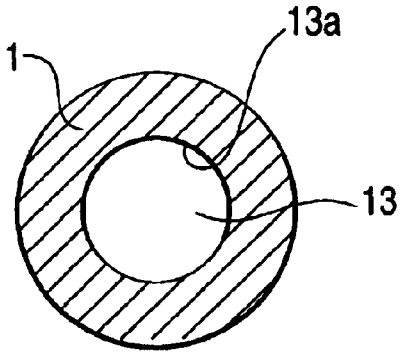
FIG. 3A is a section view taken along the line B—B in FIG. 2A.
Figure 3B:
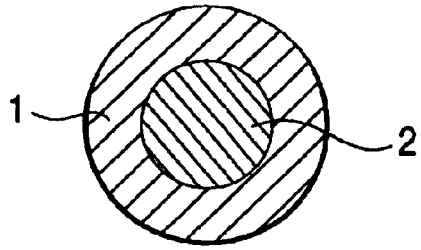
FIG. 3B is a section view taken along the line B'-B' in FIG. 2B.

FIGS. 3A and 3B show section shapes of the wire connecting portion 1 before and after the connection. In the wire connecting portion 1 which has a larger diameter in FIG. 3A, the diameter is slightly reduced as a result of the swaging process, and the core 2 of the wire 11 is closely contacted with an inner peripheral face 13*a* of a hole 13 of the wire connecting portion 1 without forming a gap therebetween. No gap is formed between the element wires of the core 2.

Figure 4:
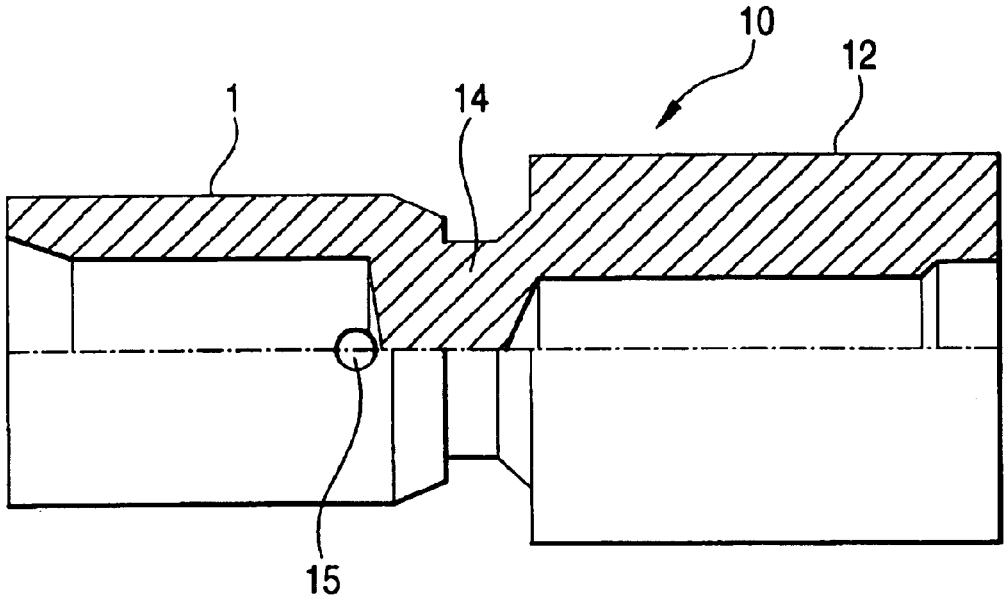
FIG. 4 is a half-cutaway view showing one mode of a terminal (a view in which a section is shown in one side with respect to the center line, and the appearance is shown in the other side).

FIG. 4 is a half-cutaway view showing in detail the configuration of the terminal 10. The mating terminal connecting portion 12 is formed into a larger thickness, and the wire connecting portion 1 is formed so as to have thickness which is about one half of that of the mating terminal connecting portion 12. The inner diameter of the wire connecting portion 1 is larger than that of the mating terminal connecting portion 12. When radial crimping is performed by the 'swaging process while rotating the dies 7 (FIG. 1) in the circumferential direction, the wire connecting portion 1 is smoothly crimped by a uniform force without compulsion, and hence the wire connecting portion 1 can be thinned. When the wire connecting portion 1 is thinned, the close contactness of the wire 11 (FIG. 2) with respect to the core 2 is enhanced.

The length of the wire connecting portion 1 is slightly shorter than that of the mating terminal connecting portion 12. The connecting portions 1 and 12 are formed into a tubular shape, and coupled to each other through a small-diameter partition wall 14 which is in the center in the longitudinal direction. A small hole 15 for air vent is passed through the basal side (on the side of the partition wall 14) of the wire connecting portion 1, so that air in the wire connecting portion 1 can be discharged through the small hole 15 during the swaging process. For example, a pin-like (male) terminal which has a plurality of elastic contact pieces (not shown) on the periphery is to be inserted into the mating terminal connecting portion 12 to be connected thereto. Alternatively, an elastic contacting member (not shown) which has a plurality of elastic contact pieces on the periphery is fitted into the mating terminal connecting portion 12; and a counter male terminal is inserted inside the elastic contact pieces to be connected thereto. The terminal 10 is a female terminal.

In such a swaging process, the inner diameter and thickness of the wire connecting portion 1 of the terminal 10 can be variously set in accordance with the outer diameter of the core 2 of the wire 11. The wire 11 is not restricted to a large-diameter one, and may be a small-diameter one. When the dies 7 and the like are replaced with ones of other sizes, even a small-diameter wire which is to be connected by using an existing crimp terminal (not shown) can be connected by using a terminal (10) of the same type as that of FIG. 4.

The terminal 10 of FIG. 4 can be easily formed by, for example, forging or machining. The mating terminal connecting portion 12 of the terminal 10 of FIG. 4 may be formed as, for example, a tab-like (male) terminal, so that the terminal 10 is used as a male terminal.

Figure 5:
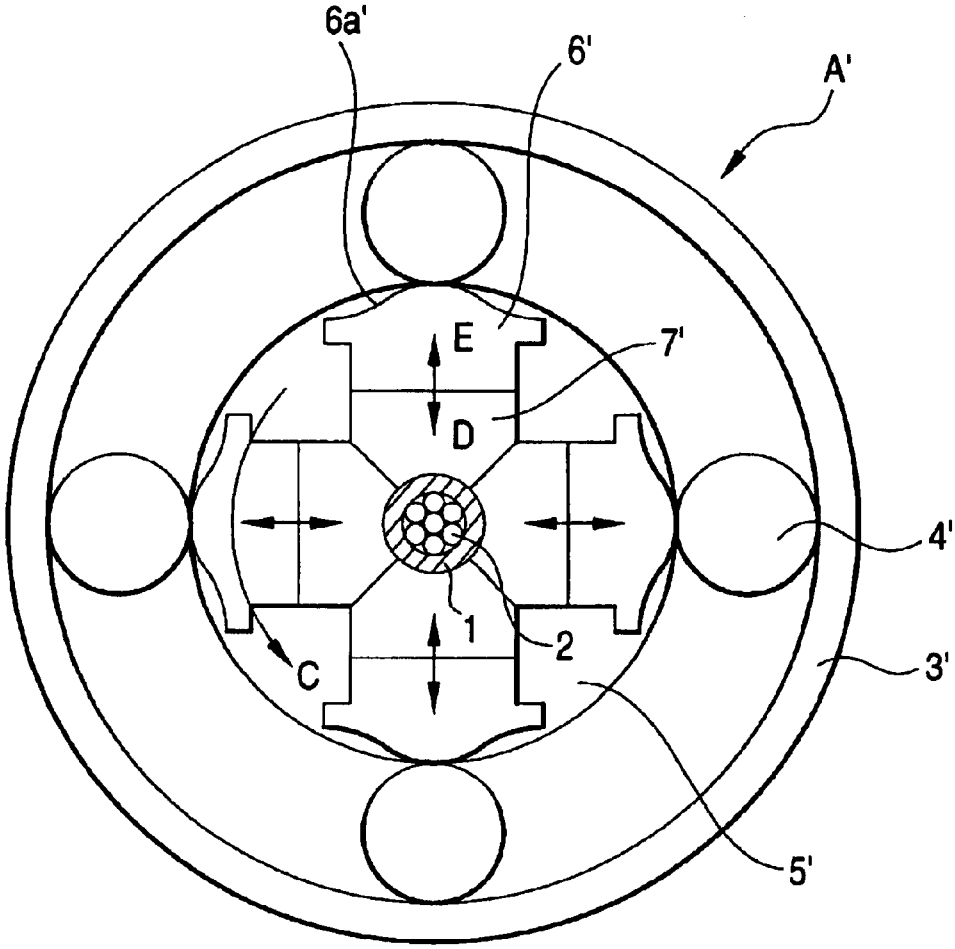
FIG. 5 is a front view showing another mode of the processing section of the rotary swaging machine.

FIG. 5 is a diagram showing another mode of a processing section A' of the rotary swaging machine. The reference numeral 1 denotes a tubular wire connecting portion of a terminal, 2 denotes a core of a wire, 31 denotes a ring, 4' denotes rollers, 5' denotes a spindle, 6' denotes buckers (hammers), and 7' denotes dies. In the processing section A' of the machine, the four dies 7' and the buckers 6' are equally arranged at intervals of 90 deg., and the number of the dies 7' is larger than that in the processing section A of the machine of FIG. 1, so that the wire connecting portion 1 of the terminal is efficiently beaten little by little by the four dies 7' to be crimped. As a result, the crimping is performed more uniformly, and inward internal stress of the wire connecting portion 1 is more uniformly applied on the core 2 of the wire.

When the spindle 5' is rotated by a motor which is not shown in FIG. 5, the dies 7' and the buckers 6' are integrally rotated in the direction of the arrow C. When the tops of the ridge-like cam surfaces 6*a*' of the buckers 6' are in contact with the rollers 4', the dies 7' are inward closed as indicated by the arrows D to radially beat (compress) the wire connecting portion 1 of the terminal. While the base portions of the cam surfaces 6*a*' are in contact with the roller 4', the dies 7' are outward opened by a centrifugal force as indicated by the arrows E. These operations are repeated at a shorter pitch (which is one half of the pitch in the case of FIG. 1).

Figure 6:
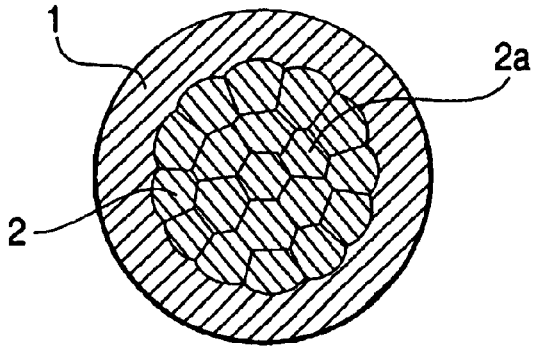
FIG. 6 is a section view showing a connecting portion between the terminal and the wire after crimping.
Figure 7:
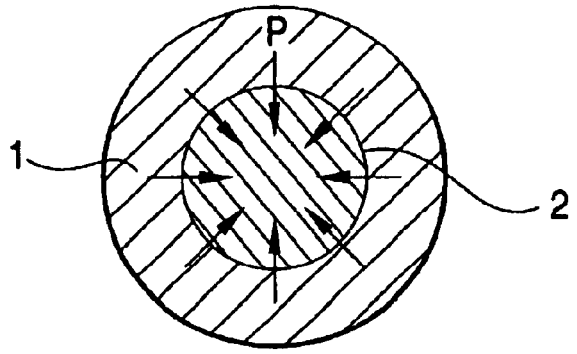
FIG. 7 is a diagram in which internal stress in the connecting portion after crimping is indicated by arrows P.

FIG. 6 is a section view showing a state where the core 2 of the wire is crimp-connected into the wire connecting portion 1 of the terminal. As shown in FIG. 7, internal stress (crimp force) uniformly acts from various areas in the circumferential direction of the circular wire connecting portion 1 toward the center of the core 2 of the wire, so that uniform crimp forces P are applied to the core 2. Therefore, the element wires 2*a* (FIG. 6) constituting the core 2 are deformed into a substantially honeycomb-like (hexagonal) shape, and no gap is formed between the element wires 2*a*. Since the core 2 is closely contacted with the wire connecting portion 1 uniformly in the circumferential direction, no gap is formed therebetween.

The above-described rotary swaging process is a mode of the connecting method. The method of elastically deforming the terminal 10 (FIG. 2) and the wire 11 in the whole circumference to pressure-connect them may be performed by using another technique. The hexagonal crimping process of the conventional art (FIG. 10) is not elastic deformation in the whole circumference, but elastic deformation in six directions. The elastic deformation in the whole circumference means that all of the whole circumference of the tubular wire connecting portion 1 of the terminal is uniformly elastically deformed.

As a result of the pressure-connection in the whole circumference, deformation is uniformly conducted over a range extending even to the center of the core 2 of the wire 11, and no gap is formed between the element wires 2*a*, and between the core 2 and the wire connecting portion 1. Therefore, the contact area is increased, and a stabilized low electric resistance is obtained.

In the case where the joining face, i.e., the inner peripheral face of the wire connecting portion 1 is a completely clean metal surface and the electrical property of the contact portion, i.e., the wire connecting portion 1 is identical with that of the base material, i.e., the terminal 10, usually, the constriction resistance Rc is indicated by the following expression:

$$Rc=Pm/2a$$

(where Pm is the specific resistance of the base material, and a is the radius of the true contact area).

From the expression, it will be seen that, when the same contact pressure is applied to the contact face, for example, the constriction resistance Rc in the connecting portion is smaller as the obtained true contact area is wider. Therefore, the electric resistance is lower as the contact area is wider.

When the section of the connecting portion of FIGS. 6 and 7 is observed through actual photographs (not shown), it is seen that, since the terminal and the wire are pressure-connected by means of elastic deformation over the whole circumference, there is no gap between the core 2 and the wire connecting portion 1, and between the element wires 2*a*, and the whole range extending to the center of the core 2 is uniformly deformed. As a result, an ideal connection state is obtained at a low electric resistance.

Figure 8:
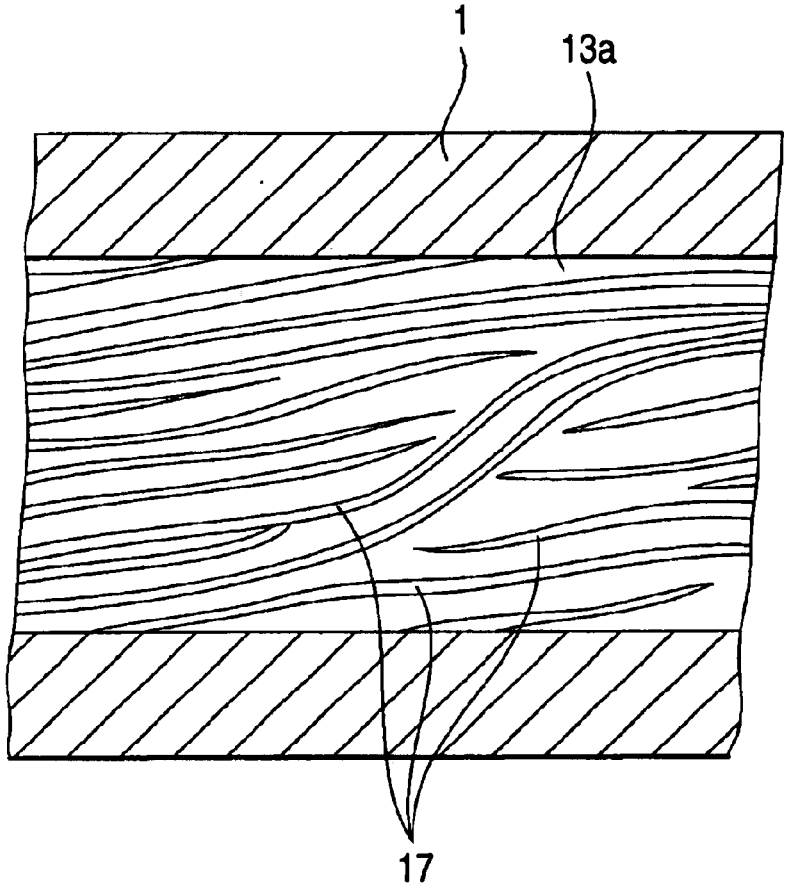
FIG. 8 is a section view showing an inner face of a wire connecting portion of the terminal which is disassembled after crimping.

FIG. 8 shows the state of the inner peripheral face 13*a* of the hole 13 of the wire connecting portion 1 in the case where the core 2 of the wire 11 is crimp-connected to the wire connecting portion 1 of the terminal 10 by a swaging process and the wire connecting portion 1 is then cut to remove the core 2 (the figure is a tracing of a photograph). A large number of grooves 17 which are traces of biting of the element wires 2*a* are formed in the entire inner peripheral face 13*a* of the wire connecting portion 1. From the figure, it will be seen that the element wires 2*a* were closely contacted with the wire connecting portion 1 in a very strong and uniform manner. Since the element wires 2*a* are inclined along the direction of twist, the grooves 17 are obliquely formed.

Figure 9:
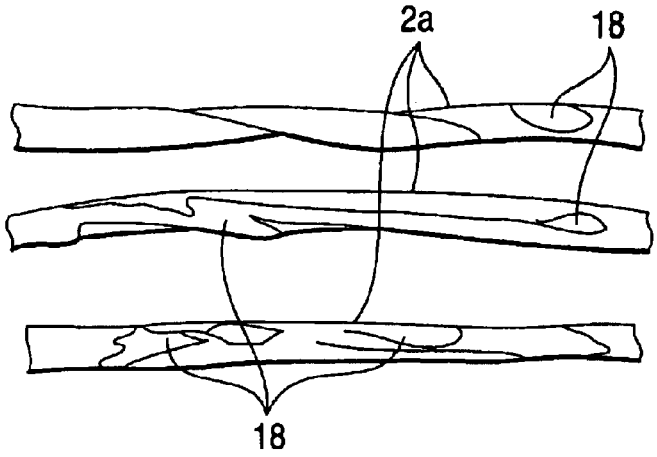
FIG. 9 is a plan view showing the surface condition of element wires of the wire which is disassembled after crimping.

FIG. 9 shows the surface condition of the element wires 2*a* after crimping (the figure is a tracing of a photograph). A large number of impressions 18 which are traces of biting among the element wires 2*a* are formed in the surfaces of the element wires 2*a*. From the figure, it will be seen that the element wires 2*a* were radially compressed by a strong and uniform force. The states of FIGS. 8 and 9 prove that the electrical connection between the terminal 10 and the wire 11 is highly reliable.

FIGS. 10 to 13 show another embodiment of the method and structure for connecting a terminal with a wire according to the invention.

Figure 10:
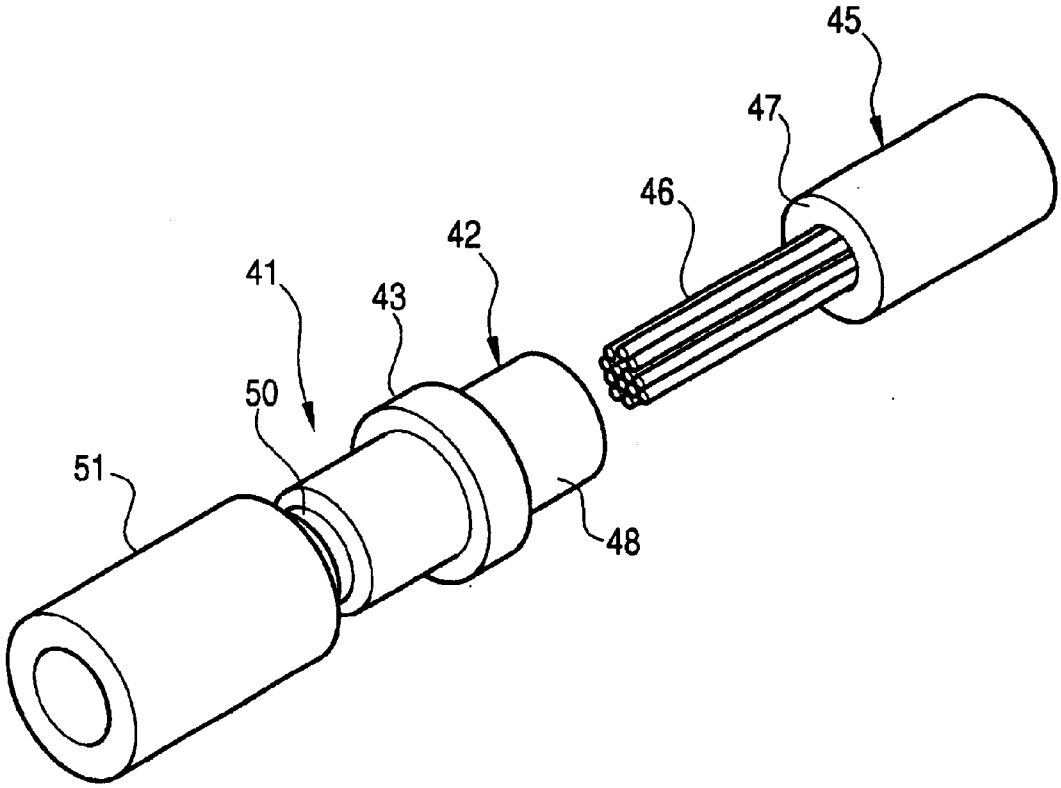
FIG. 10 is an exploded perspective view showing another embodiment of the structure for connecting a terminal with a wire according to the invention, in a state before connection.
Figure 11:
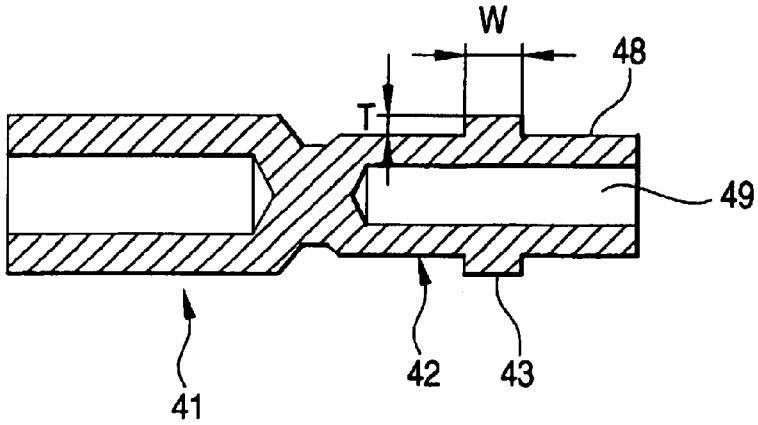
FIG. 11 is a longitudinal section view showing only the terminal.
Figure 12:
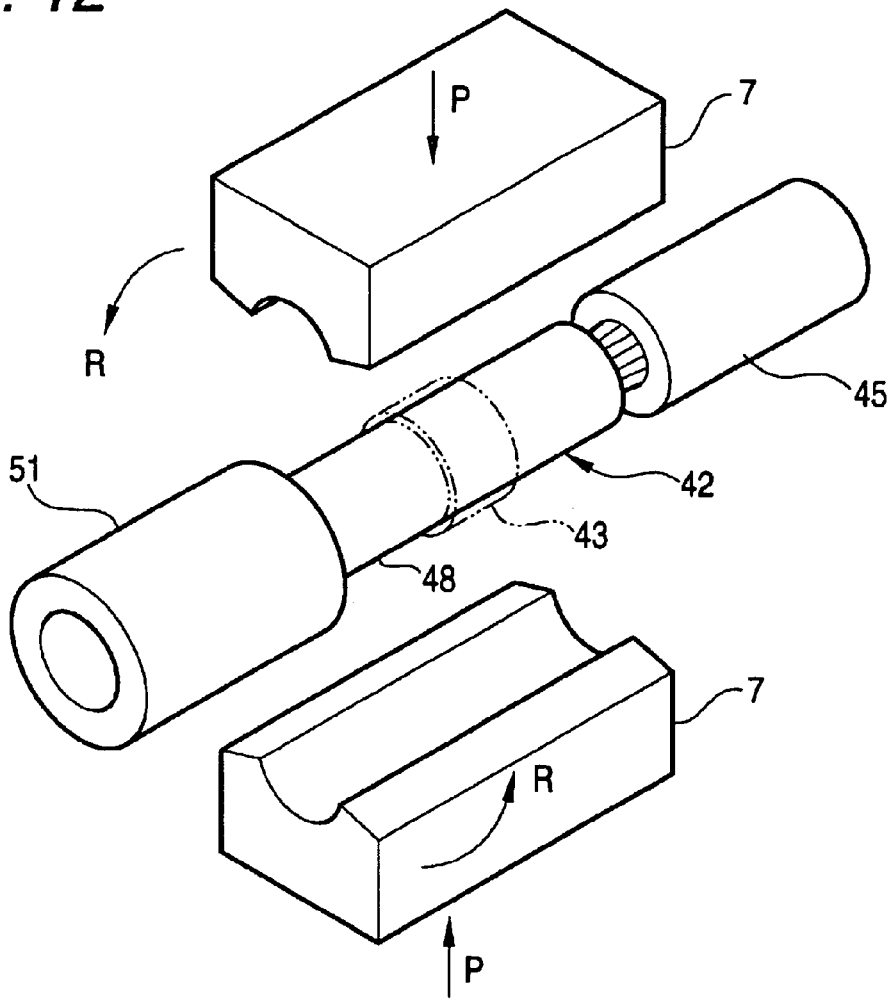
FIG. 12 is a perspective view showing a method of connecting the terminal using the connecting structure of FIG. 10 with a wire (a state in the course of a process).
Figure 13:
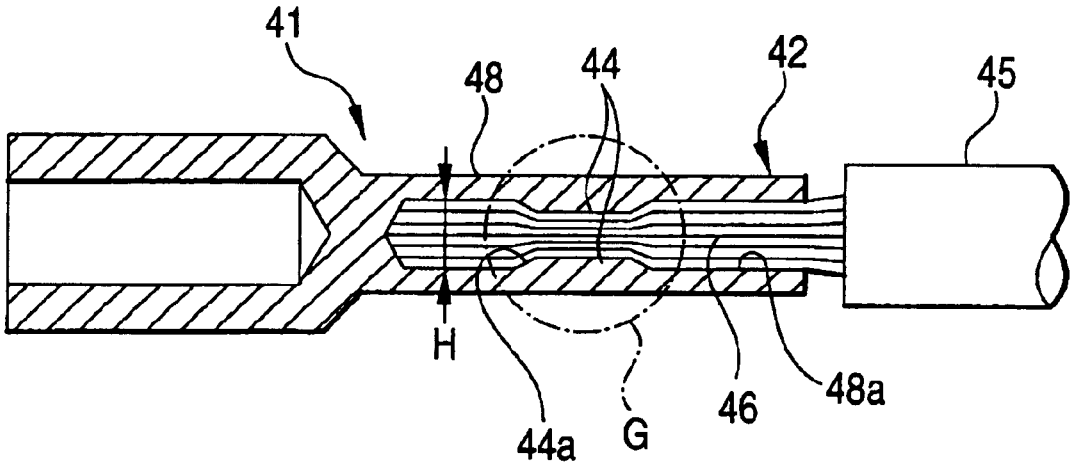
FIG. 13 is a longitudinal section view showing the structure for connecting a terminal with a wire, in a state after connection.

As shown in FIGS. 10 and 11, the connecting method and the connecting structure are characterized in that a ridge (protrusion) 43 is annularly formed integrally on the outer peripheral face of a tubular wire connecting portion 42 of a terminal 41. As shown in FIG. 12, the wire connecting portion 42 is by radially beaten uniformly over the whole circumference by the dies 7 of the rotary swaging machine, to be compressively deformed. During this process, as shown in FIG. 13, a volume part corresponding to the ridge 43 is inward annularly projected from the inner peripheral face of the wire connecting portion 42 to cause the projected part 44 to annularly bite a core 46 of a wire 45. As a result, the wire connecting portion and the core can be contacted with each other strongly and surely by the wedge effect.

Referring to FIG. 10, the ridge 43 is disposed in a center area in the longitudinal direction of a tubular peripheral wall 48 of the wire connecting portion 42. As shown in FIG. 11, preferably, the ridge 43 is placed in the center in the longitudinal direction of a wire insertion hole 49 which is in the wire connecting portion 42, and which has a circular section shape.

For example, as shown in FIG. 11, the ridge 43 is formed so as to have a rectangular section shape, the thickness T of the ridge 43 is set to be approximately equal to or smaller than the thickness of the peripheral wall 48, and the width W of the ridge 43 is set to about one fifth of the length of the wire connecting portion 42. The section shape of the ridge 43 may be trapezoidal or triangular. For example, the ridge 43 is formed by cutting simultaneously with a process of cutting the wire connecting portion 42, or formed simultaneously with a process of rolling the wire connecting portion 42. Alternatively, the ridge 43 may be formed by a separate ring member (not shown), and pressing into the tubular peripheral wall 48 by performing a rotary swaging process under the state where the ring member is fitted onto the outer periphery of the peripheral wall 48.

Referring to FIGS. 10 and 11, the wire connecting portion 42 is coaxially continuous to a mating terminal connecting portion 51 in the front half, through a small-diameter partition wall 50. The mating terminal connecting portion 51 and the partition wall 50 are configured in the same manner as those of the above-described embodiment (FIGS. 2 and 4), and hence their description is omitted. The wire connecting portion 42 also is configured in the same manner as that of the above-described embodiment except the ridge 43. The wire 45 also is identical with that of the above-described embodiment. An insulation cover 47 in a tip end portion of the wire 45 is peeled off to expose the core 46 which is a conductor.

Under a state where the core 46 of the wire 45 is inserted into the wire connecting portion 42 of the terminal 41, as shown in FIG. 12, the wire connecting portion 42 is set between the dies 7 of the processing section of the rotary swaging machine, and the machine is then operated. While rotating in the circumferential direction of the wire as indicated by the arrow R, the dies 7 advances and retracts in a radial direction of the wire as indicated by the arrows P to repeatedly beat the wire connecting portion 42. As a result, the wire connecting portion 42 is elongated in the longitudinal direction while being compressed uniformly over the whole circumference.

In the process, the ridge 43 is compressed in advance of the peripheral wall 48 of the wire connecting portion 42, gradually pressed into the peripheral wall 48, and then annularly projected from the inner peripheral face 48*a* of the peripheral wall 48 into the wire insertion hole 49 (FIG. 11) as shown in FIG. 13. Referring to FIG. 12, the ridge 43 is compressed so as to be flush with the outer peripheral face of the peripheral wall 48, and as described above elongated in the axial direction of the wire together (integrally) with the peripheral wall 48 while being compressed in a radial direction of the wire.

As indicated by the reference numeral G in FIG. 13, finally, the ridge 43 (FIG. 12) is annularly projected from the inner peripheral face 48*a* of the peripheral wall 48, and the inner diameter of the projected part 44 is smaller than the compression outer diameter H of the core 46 of the wire 45 to deeply bite the core 46, so that the retaining force (mechanical strength) of the wire 45 is improved by the wedge effect. Furthermore, the projected part 44 is firmly contacted with the core 46 while strongly compressing the core 46 over the whole circumference, so that the reliability of the electrical connection is improved. Because of the improved retaining force, even when a strong pulling force is applied on the wire 45, slipping-off of the core 46 from the wire connecting portion 42 is surely prevented from occurring.

Referring to FIG. 13, the outer diameter of the area where the ridge 43 has been formed is equal to that of the peripheral wall 48, and the outer peripheral face of the wire connecting portion 42 is configured as an arcuate face which is free from a projection due to the ridge 43. The front and rear ends 44*a* of the inner projected part 44 are formed into a tapered shape. The tapered portions 44*a* are smoothly in contact with the core 46, whereby element wires in the outer peripheral side of the core 46 are prevented from being broken.

Before the swaging process of FIG. 11, no projection is formed on the inner peripheral face of the wire insertion hole 49 which is inside the wire connecting portion 42. Therefore, the core 46 of the wire 45 (FIG. 10) can be inserted without hitch or smoothly and surely into the wire insertion hole 49.

The shape of the ridge 43 is not restricted to the annular shape of the same width. If formation is possible, the width W may be changed in a wave-like or rectangular wave-like form, or the thickness T may be changed. The number of the ridge 43 is not limited to one, and two or core ridges may be formed.

In the first embodiment, the annular ridge 43 is used. The protrusion is not restricted to this. For example, the annular ridge 43 may be partly cut away intermittently along the circumference, so that a plurality of projections (protrusions) which are not shown are arranged at, for example, regular intervals. The shape of the projections may be suitably selected from various shapes including a rectangular, a short column, and a pyramid. The number of projections may be restricted to one. Preferably, two projections may be arranged at intervals of 180°, or three or more projections may be arranged at regular intervals. In place of the annular arrangement, the projections may be arranged in plural parallel rows in the longitudinal direction of the wire connecting portion, or in a zigzag manner.

The ridge 43 may be straightly arranged in the longitudinal direction in place of the circumferential direction of the wire connecting portion. In this case, preferably, two or more ridges may be regularly arranged in the direction of 180°.

Alternatively, the wire connecting portion 42 of the terminal 41 may be radially compressively deformed uniformly over the whole circumference by a method other than the rotary swaging process. In this case also, the ridge 43 or the projections are projected from the inner peripheral face of the peripheral wall 48 by a circumferential crimping unit, to bite the core 46 of the wire 45. Even when the ridge 43 remains on the outer peripheral face of the peripheral wall 48 to be slightly projected, there arises no problem in a practical use.

As described above, since the wire connecting portion of the terminal is compressed in a radial direction of the wire and uniformly over the whole circumference, the formation of burrs between a pair of dies in the conventional art (burrs are produced because the portion is not compressed uniformly over the whole circumference) is eliminated. Furthermore, internal stress which is uniform over the whole circumference acts on the wire connecting portion of the terminal, and also on the core of the wire which is compressed inside the wire connecting portion. Namely, uniform internal stress which is directed to the center of the wire acts on the wire connecting portion. Therefore, uniform internal stress which is directed to the outside (directed to the wire connecting portion) acts on the core, and stress concentration, which may be produced in a crimped portion in the conventional art is eliminated. The wire connecting portion and the core are closely contacted with each other without forming a gap therebetween, the element wires of the core are closely contacted without forming a gap, and sure connection of a low resistance is attained. As a result, the reliability of the electrical connection between the terminal and the wire is improved.

While rotating the dies, the wire connecting portion is compressed by the dies in a radial direction of the wire over a whole circumference. Therefore, the wire connecting portion of the terminal can be compressed more surely in a radial direction of the wire and uniformly over a whole circumference.

By the circumferential crimping of the wire connecting portion, the protrusion on the outer periphery is inward pressed, and projected from the inner periphery of the wire connecting portion to bite the core. Therefore, the force of fixing the wire to the terminal is enhanced by the wedge effect, and slipping-off of the core from the terminal when the wire is pulled is prevented from occurring, with the result that the reliability of the electrical connection is improved.

The annular ridge is annularly projected from the inner periphery of the wire connecting portion. The core of the wire is crimped by the projected part uniformly in the circumferential direction, and slipping-off of the core from the wire connecting portion is surely prevented from occurring. When a plurality of projections are used in place of the annular ridge, the core is uniformly crimped without compulsion at plural places in the longitudinal direction, and hence the core is prevented from being damaged.

Second Embodiment

Figure 14A:
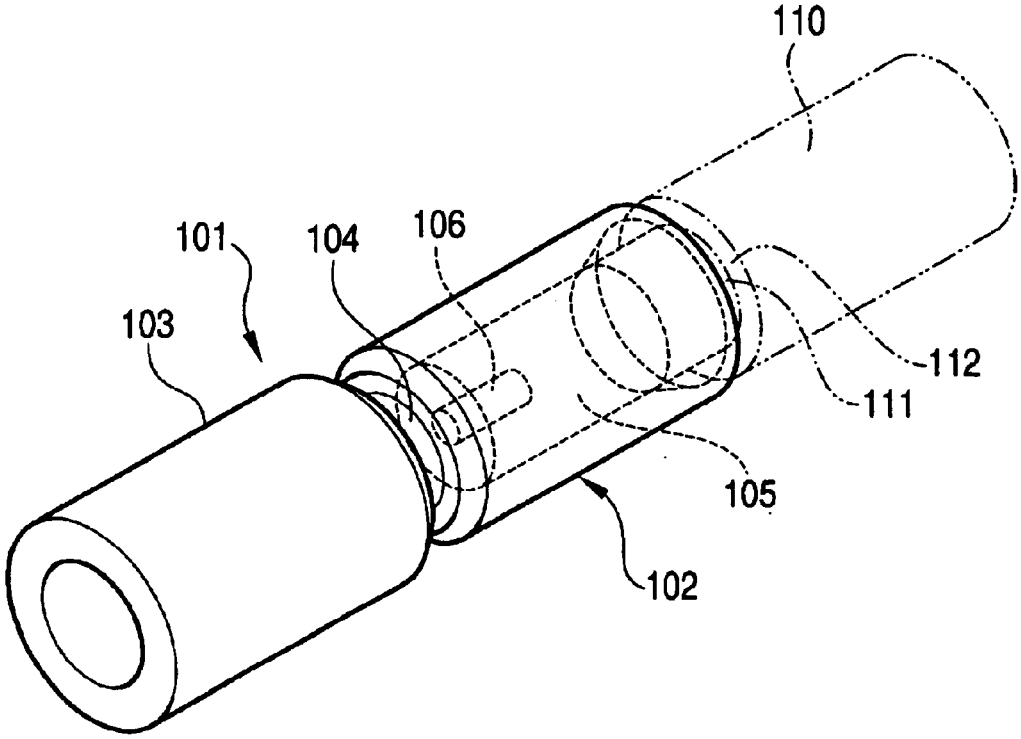
FIG. 14A is a perspective view showing a second embodiment of the circumferential crimp connection terminal of the invention.
Figure 14B:
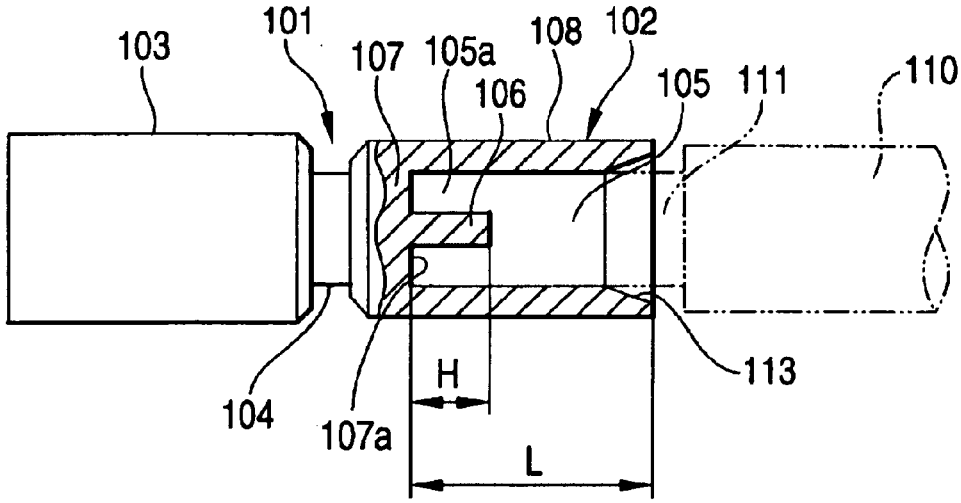
FIG. 14B is a side view in which main portions are shown in section.

FIGS. 14A and 14B show a second embodiment of the circumferential crimp connection terminal of the invention. In the figures, an insertion state of a wire before connection is indicated by chain lines.

The circumferential crimp connection terminal 101 is preferably made of copper, aluminum, or an alloy of the metals. In the terminal, a tubular wire connecting portion 102 is formed in one side of the longitudinal direction, and a tubular electric contacting portion 103 for a counter male terminal (not shown) is formed in the other side. Between the portions, a constricted or small-diameter portion 104 is formed. A columnar small-diameter contact protrusion 106 is formed in the center of a wire insertion hole (internal space) 105 which is formed in the wire connecting portion 102 and which has a circular section shape. The contact protrusion is projected integrally from a bottom face 7*a*.

The wire connecting portion 102 is configured by a tubular peripheral wall 108, and a base wall (bottom wall) 107 which is continuous to the peripheral wall 108, and which is inside the small-diameter portion 104. The contact protrusion 106 is projected from the center of the bottom face 107*a* of the base wall 107. The axial center of the contact protrusion 106 coincides with the axis of the wire connecting portion 102, i.e., the center of the wire insertion hole 105.

For example, the length (depth) L of the wire insertion hole 105 before wire connection is 15 mm, the length H of the contact protrusion 106 is 5 mm which is one third of the length L of the wire insertion hole 105, the outer diameter of the peripheral wall 108 is 11 mm, the inner diameter of the peripheral wall 108 is 7 mm, and the outer diameter of the contact protrusion 106 is 2 mm which is equal to the thickness of the peripheral wall 108.

These values are exemplarily shown. The dimensions of the components are adequately set in accordance with the size of the wire diameter. However, the length of the contact protrusion 106 must be equal to or shorter than that of the wire insertion hole 105. Preferably, the length of the contact protrusion 106 is one half or less of that of the wire insertion hole 105, or is about one third of that of the wire insertion hole 105, from the viewpoints of the insertability of a core 111 of a wire 110 into the wire connecting portion 102, and the contact performance between the core 111 and the contact protrusion 106.

As required, the core 111 of the wire 110 is previously untwisted, or the core 111 which is originally untwisted is used. Preferably, the tip end of the core 111 is previously widened into a fan-like shape to allow the contact protrusion 106 to smoothly enter the core 111. A tapered guiding chamfer 113 is formed on the inner opening edge of the wire connecting portion 102. As required, a guide jig (not shown) having a tapered inner face is used so that the fan-shaped core 111 can be smoothly inserted into the wire connecting portion 102.

For example, the contact protrusion 106 can be processed by the following method. First, the wire insertion hole 105 of the wire connecting portion 102 is bored to a depth at a middle position in the longitudinal direction by using a larger-diameter drill (not shown). Then, the wire insertion hole 105 is annularly bored to the bottom face 107*a* of the base wall 107 by using a smaller-diameter drill (not shown), whereby the columnar contact protrusion 106 is formed in an annular space 105*a*. Alternatively, the contact protrusion 106 may be integrally molded in the wire connecting portion 102 by a technique such as casting or forging.

Hereinafter, a mode of the method of connecting the circumferential crimp connection terminal 101 will be described.

First, the core 111 of the wire 110 is inserted into the wire connecting portion 102 of the terminal 101 as indicated by the chain lines in FIG. 14. The wire 110 is an insulation covered wire, and configured by the core 111 made of copper, and a covering portion 112 which is made of an insulating resin, and which covers the core 111. The core 111 is configured by a plurality of element wires. The insulation covering portion 112 in a terminal of the wire 110 which has been cut into a predetermined length is peeled off by a cutter or the like to expose a part of the core 111. The exposed part is inserted into the wire connecting portion 102.

Figure 15:
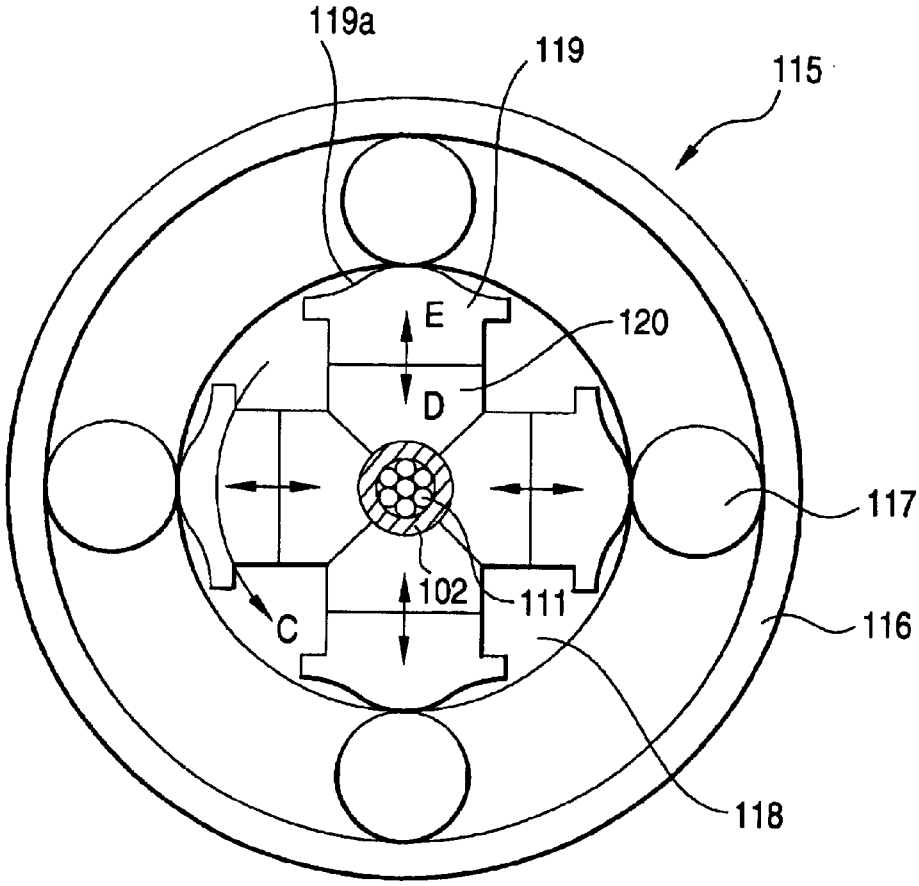
FIG. 15 is a front view showing a mode of a state where the circumferential crimp connection terminal is connected to a wire by using a rotary swaging machine.

Under this state, the wire connecting portion 102 is crimped uniformly over the whole circumference in a radial direction of the wire, by using a rotary swaging machine which is a rotary swaging machine. FIG. 15 shows a mode of a processing section 115 of the rotary swaging machine. The connecting method based on the rotary swaging process is disclosed in the first embodiment. Referring to FIG. 15, 102 denotes the tubular wire connecting portion of the terminal 101, 111 denotes the core of the wire 110, 116 denotes an outer ring, 117 denotes rollers, 118 denotes a spindle, 119 denotes hammers (buckers), and 120 denotes dies.

The spindle 118 is rotated by a motor which is not shown in FIG. 15. In accordance with this rotation, the dies 120 and the hammers 119 are integrally rotated in the direction of the arrow C. When the tops of ridge-like cam surfaces 119*a* of the hammers 119 are in contact with the rollers 117, the dies 120 are inward closed as indicated by the arrows D to radially strike (compress) the wire connecting portion 102 of the terminal 101. While the base portions of the cam surfaces 119*a* are in contact with the rollers 117, the dies 120 are outward opened by a centrifugal force as indicated by the arrows E.

When these operations are repeated at a short pitch, the process of crimping the wire connecting portion 102 is performed uniformly on the whole circumference, so that inward internal stress of the wire connecting portion 102 is uniformly applied on the core 111 of the wire 110. As a result, the element wires constituting the core 111 are deformed into a substantially honeycomb-like shape to be closely contacted with one another, and the core 111 is closely contacted with the wire connecting portion 102 in a uniform manner in the circumferential direction.

The rotary swaging machine has been simply described as an example, and a modification may be appropriately performed. For example, the hammers 119 and the dies 120 may be configured by a pair of upper and lower ones, or the number of the rollers 117 may be increased. The above-described rotary swaging process is an example of the connecting method. The terminal 101 and the wire 110 may be plastically deformed in the whole circumferential direction by another technique to be pressure-connected.

Figure 16:
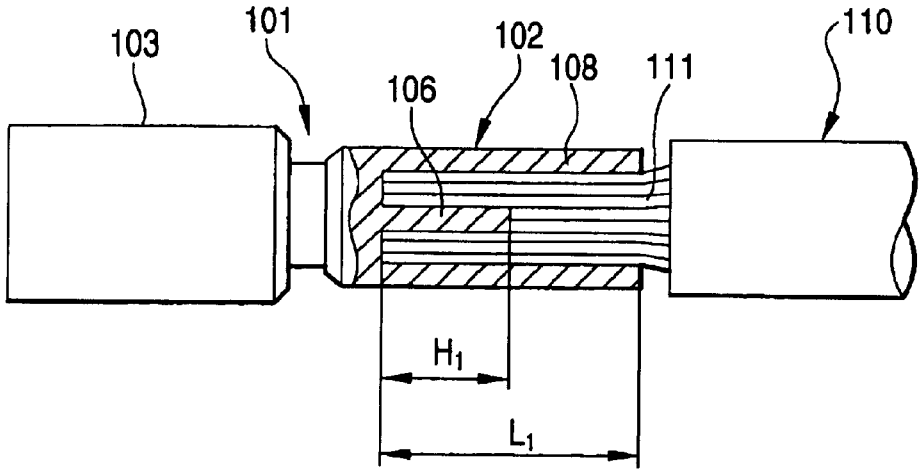
FIG. 16 is a side view which shows a state where the circumferential crimp connection terminal is connected to the wire, and in which main portions are shown in section.

FIG. 16 shows a state where the terminal 101 and the wire 110 are connected to each other by the swaging process of FIG. 15.

As shown in FIG. 16, the wire connecting portion 102 of the terminal 101 is radially compressed to be reduced in diameter and elongated in the longitudinal direction as compared with the initial state of FIG. 14B, with the result that the whole length $L_1$ of the wire connecting portion 102 is slightly increased. The core 111 of the wire 110 is radially compressed by the peripheral wall 108 of the wire connecting portion 102. In accordance with this compression, the contact protrusion 106 at the center is radially compressed to be elongated in the longitudinal direction while the diameter is slightly reduced. For example, the length $H_1$ of the contact protrusion 106 becomes to be about one half of the initial length L of the wire insertion hole 105. The element wires of the wire connecting portion 102 are closely contacted with the outer peripheral face of the contact protrusion 106 in a biting manner, so that the contact area with respect to the core 111 is widened and the mechanical resistance against slipping-off of the wire 110 is enhanced.

As a result, as compared with the wire connecting portion 102 in which the contact protrusion 106 is not used, and which is configured only by the peripheral wall 108, the electric resistance is lowered, and the power transmission efficiency is raised. Moreover, the wire fixing force against a pulling force applied on the wire 110 is enhanced, so that the reliability of the electrical connection is improved.

Figure 17A:
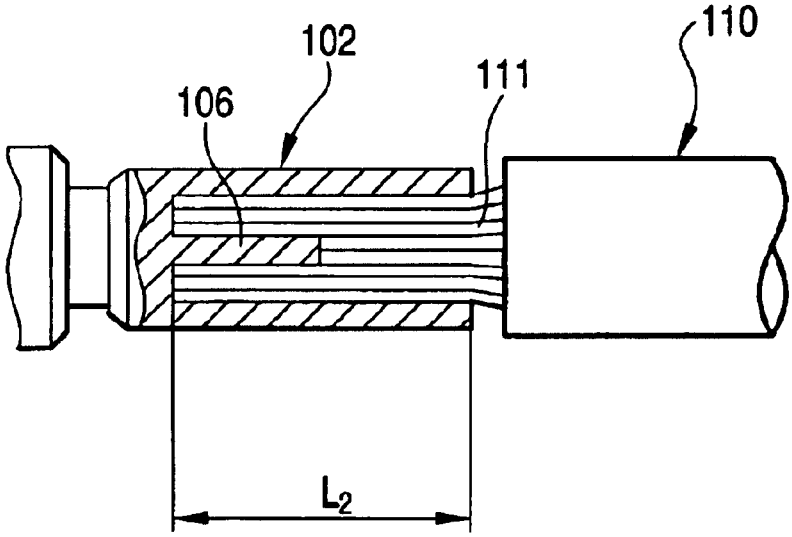
FIGS. 17A and 17B are section views showing main portions and comparison examples of lengths in the case where the circumferential crimp connection terminal of the invention, and the circumferential crimp connection terminal of the first embodiment are connected to a core of a wire by the same contact areas.
Figure 17B:
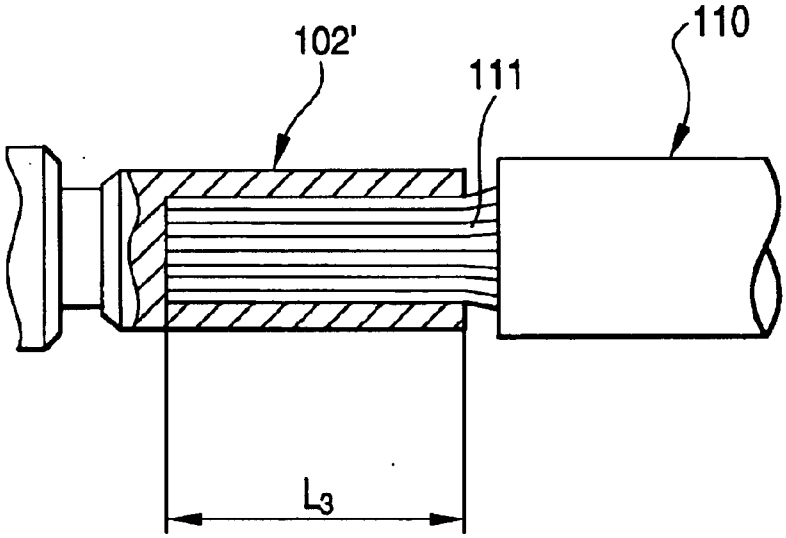

It is assumed that the contact area of the wire connecting portion 102 with respect to the core 111 of the wire 110 in the case where the contact protrusion 106 is used as shown in FIG. 17A is set to be equal to that of the wire connecting portion 1021 in the case where the contact protrusion 106 is not used as shown in FIG. 17B. Under this situation, the length $L_2$ of the peripheral wall 108 in the former case can be made shorter than the length $L_1$ in the latter case by a degree corresponding to the surface area of the contact protrusion 106. Therefore, the whole length of the terminal 101 can be shortened to allow the terminal to be miniaturized. Because of this, the length $L_2$ of the wire connecting portion 102 in FIG. 17A can be set to be shorter than the length $L_3$ of the wire connecting portion 102' in FIG. 17B.

In the second embodiment, the contact protrusion 106 is formed into a columnar shape so as to enhance the close contactness between the core 111 and the element wires. Alternatively, the contact protrusion 106 may be formed into a prism-like shape such as a triangular prism or a rectangular prism. The tip end of the contact protrusion 106 may be sharpened into a tapered shape so as to enhance the insertability into the core 111. The circumferential crimping process may be conducted in a state where both the core 111 and the insulation covering portion 112 of the wire 110 are inserted into the wire connecting portion 102. In this case, the wire insertion hole 105 is preferably formed so as to have two stages.

Figure 18A:
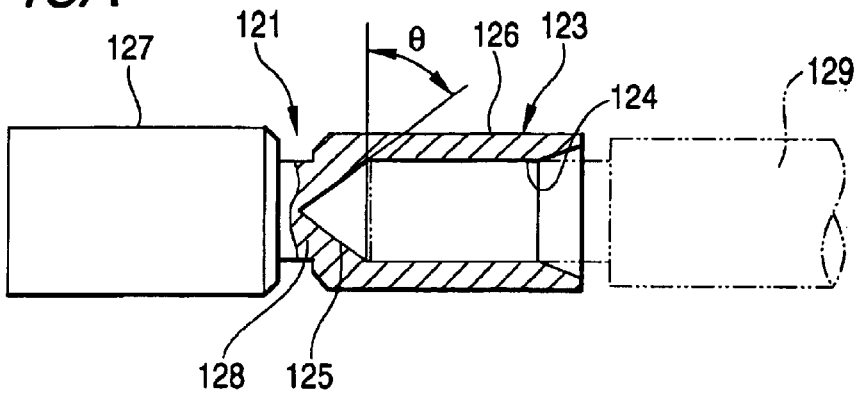
FIG. 18A is a side view which shows another embodiment (reference example) of the circumferential crimp connection terminal, and in which main portions are shown in section.
Figure 18B:
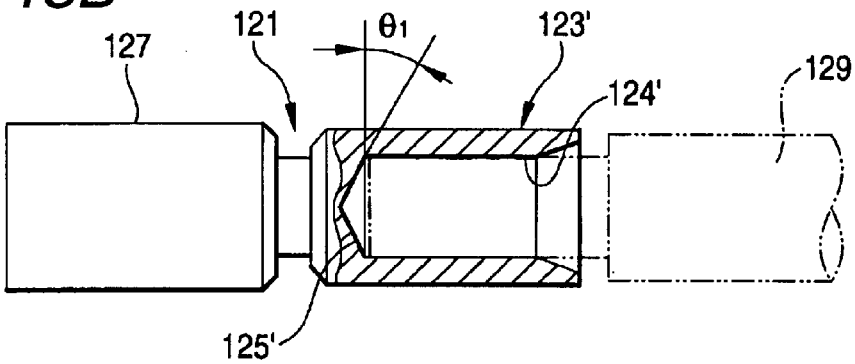
FIG. 18B is a side view which shows the circumferential crimp connection terminal of the first embodiment, and in which main portions are shown in section.

FIG. 18A shows another embodiment of the circumferential crimp connection terminal of the invention, in comparison with the first embodiment of the FIG. 18B. Each of FIGS. 18A and 18B shows the initial state of the terminal before a wire is crimp-connected to the terminal.

A circumferential crimp connection terminal 121 of FIG. 18A is characterized in that a tapered portion 125 in the bottom of a wire insertion hole 124 of a wire connecting portion 123 is deeper than that in a circumferential crimp connection terminal 122 of FIG. 18B. The tapered portion 125 is formed into a conical shape, and intersected and continuous with the inner peripheral face of a peripheral wall 126. Preferably, the intersection angle θ formed by the tapered portion 125 and the inner peripheral face of the peripheral wall 126 is, for example, about 60° or more.

Usually, the included angle (an angle corresponding to the intersection angle) of a boring drill (not shown) is about 30°. Therefore, it is preferable to process the tapered portion 125 by using a drill having a special shape, or to form the tapered portion 125 integrally with the wire insertion hole 124 by forging or casting. In the existing terminal 122, the intersection angle $\theta_1$ of a tapered portion 125' is about 30°.

The tapered portion 125 is formed by drilling a small-diameter base wall 128 which is between the wire connecting portion 123 that is in the latter half, and an electric contacting portion 127 that is in the former half. The electric contacting portion 127 incorporates an elastic contact portion (not shown) for a counter male terminal (not shown). For example, the elastic contact portion may be separately formed. This configuration is identical with that of the second embodiment of FIG. 14.

Figure 19A:
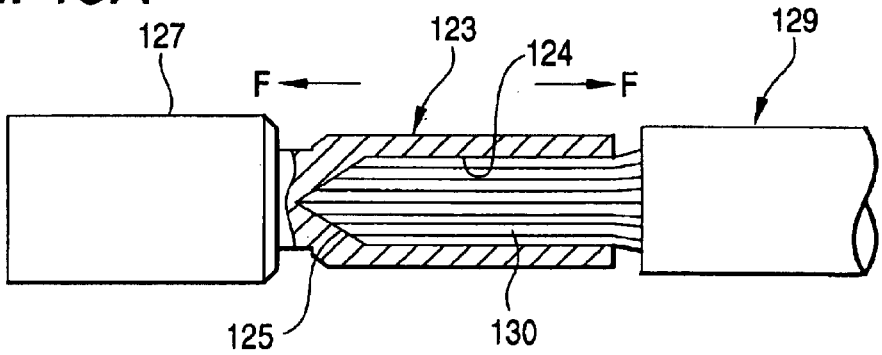
FIG. 19A is a side view which shows a state where the circumferential crimp connection terminal of the other embodiment is connected to a wire, and in which main portions are shown in section.

The wire connecting portion 123 of the terminal 121 of FIG. 18A is compressed uniformly over the whole circumference by the processing section 115 (FIG. 15) of the above-mentioned rotary swaging machine. As shown in FIG. 19A, a core 130 of a wire 129 then enters the tapered portion 125 of the wire connecting portion 123, and the core 130 elongates in both the front and rear sides in the axial direction as indicated by the arrows F.

Figure 19B:
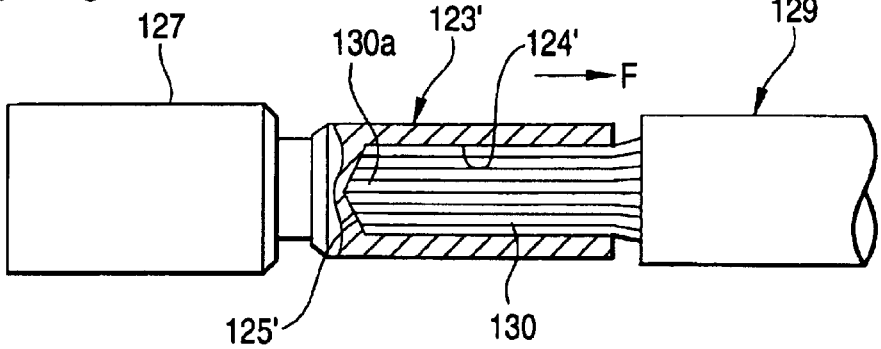
FIG. 19B is a side view which shows a state where the circumferential crimp connection terminal of the first embodiment is connected to a wire, and in which main portions are shown in section.

When the wire connecting portion 123' of the terminal 122 of FIG. 18B is compressed uniformly over the whole circumference by the rotary swaging machine, the tip end 130*a* of the core 130 of the wire 129 immediately abuts against the bottom face of the tapered portion 125' of a wire insertion hole 124' as shown in FIG. 19B, and the elongation of the core 130 is restricted only to one direction (the direction toward the opening of the wire insertion hole 24') as indicated by the arrow F.

As described above, in the mode of FIG. 19A, the core 130 elongates integrally with the wire connecting portion 123 in both the front and rear sides in the axial direction. Therefore, the contact area between the core 130 and the wire connecting portion 123 is increased as compared with the mode of FIG. 19B. In the same manner as the embodiment described above, the electric resistance is lowered, the power transmission efficiency is raised, and the reliability of the electrical connection is improved.

Figure 20A:
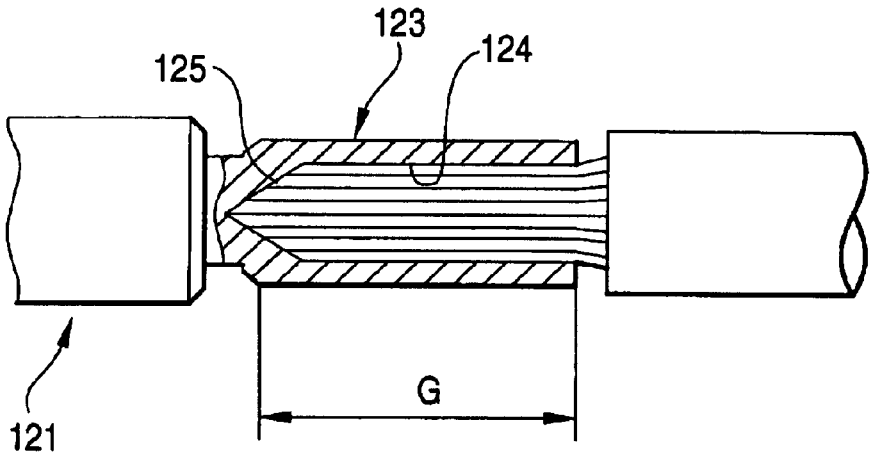
FIGS. 20A and 20B are section views showing main portions and comparison examples of lengths in the case where the circumferential crimp connection terminal of the other embodiment, and the circumferential crimp connection terminal of the first embodiment are connected to a core of a wire by the same contact areas.
Figure 20B:
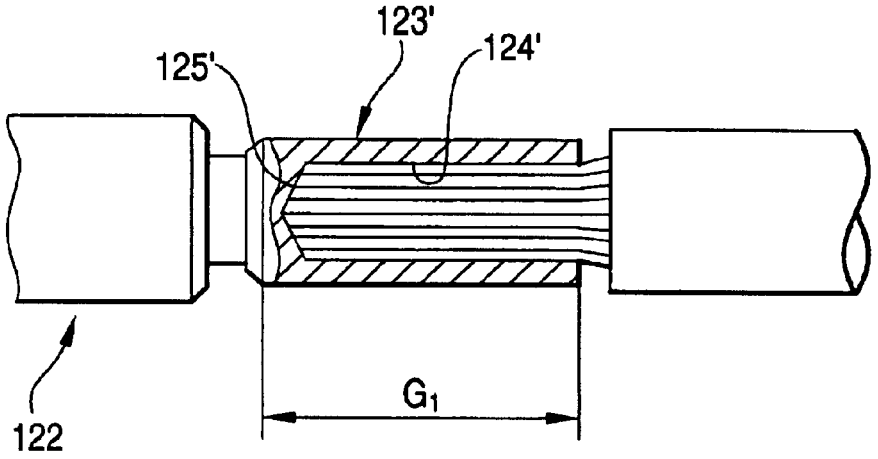
Figure 21A:
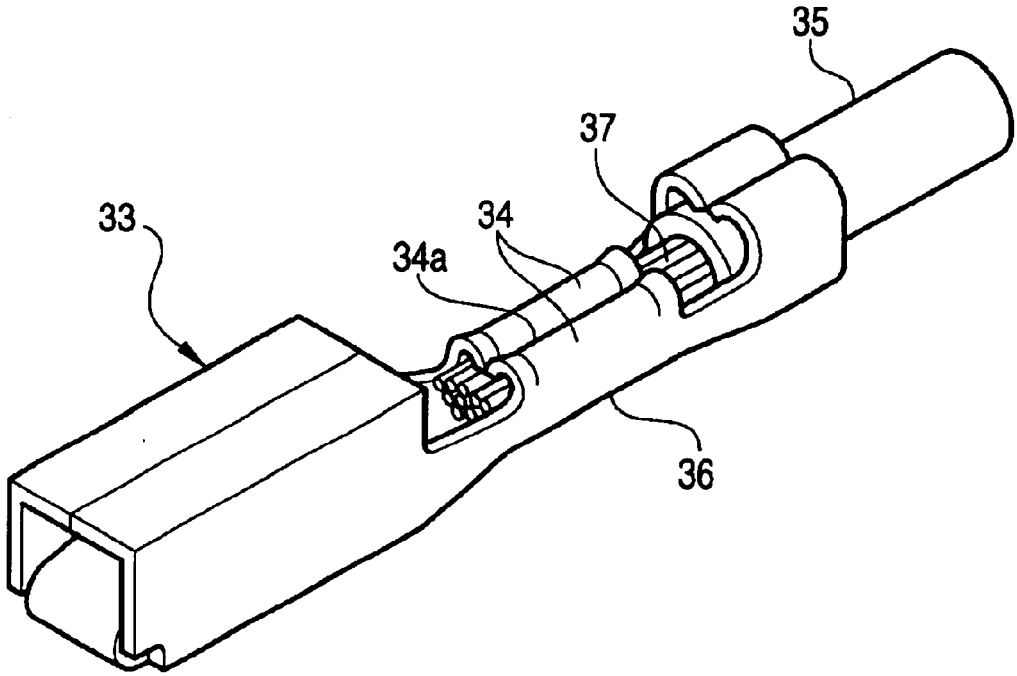
FIG. 21A is a perspective view showing one mode of a structure for connecting a terminal with a wire of the conventional art.
Figure 21B:
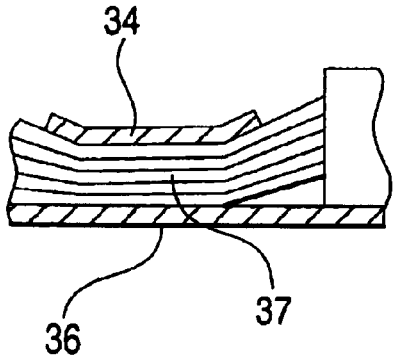
FIG. 21B is a section view showing main portions of the structure.
Figure 22:
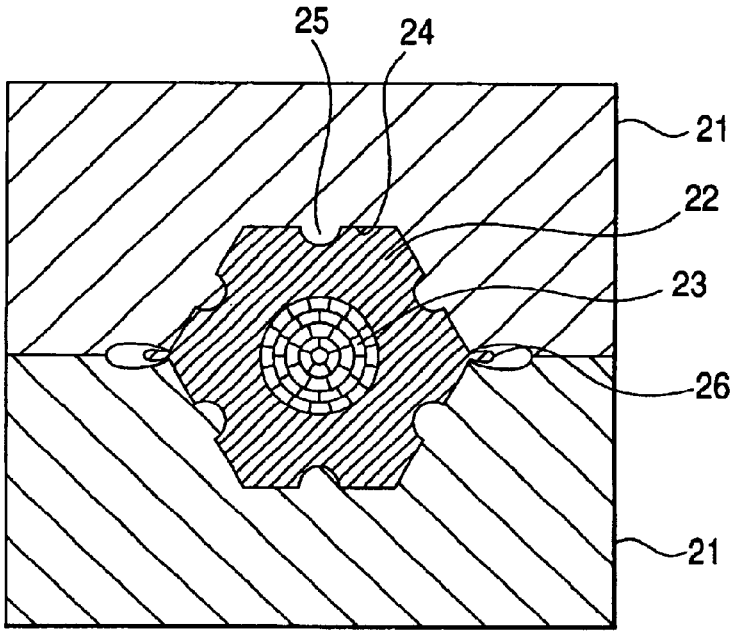
FIG. 22 is a section view showing another mode of a method of connecting a terminal with a wire of the conventional art.
Figure 23:
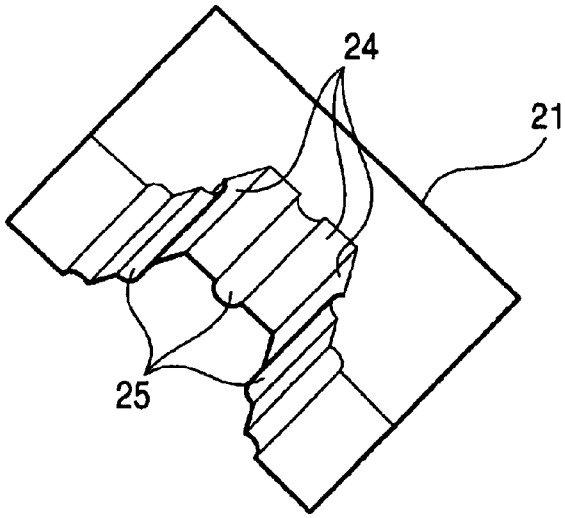
FIG. 23 is a perspective view showing a conventional die for crimping.
Figure 24:
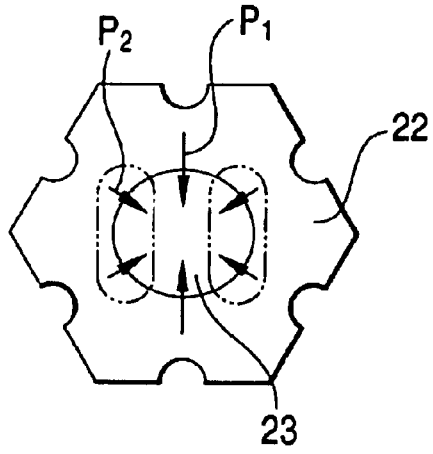
FIG. 24 is a diagram showing a problem of the conventional art by means of the difference between internal stresses $P_1$ and $P_2$.
Figure 25:
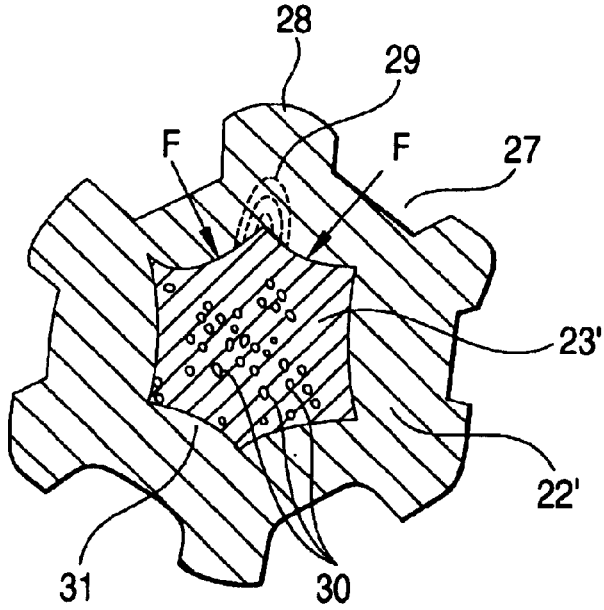
FIG. 25 is a section view showing another mode of a structure for connecting a terminal with a wire of the conventional art.

When the wire connecting portion 123 in which the wire insertion hole 124 has the deep tapered portion 125, and the wire connecting portion 123' in which the wire insertion hole 124' has the shallow tapered portion 125'or does not have a tapered portion are to be in contact with the core 130 of the wire 129 by the same contact area as shown in FIGS. 20A and 20B, the length G of the wire connecting portion 123 having the deep tapered portion 125 as shown in FIG. 20A can be set to be shorter than the length $G_1$ of the wire connecting portion 123' of FIG. 20B. Therefore, the terminal 121 can be miniaturized in the longitudinal direction.

The deep tapered portion 125 in FIG. 18A may be formed in the wire connecting portion 102 in FIG. 14 which has the contact protrusion 106. In this case, the contact protrusion 106 is projected in the wire longitudinal direction from the deepest bottom area of the tapered portion 125. According to the configuration, by the synergistic effect of the two embodiments, the contact area of the wire connecting portion 102 with respect to the core 111 of the wire 110 is further increased, and the effects of the embodiments are exerted more surely.

As described above, when a core of a wire is inserted into the wire insertion hole, the contact protrusion enters the core. Under this state, the wire connecting portion is crimped radially and uniformly over the whole circumference by the circumferential crimping unit, whereby the element wires of the core are strongly pressed against the outer peripheral face of the contact protrusion to be closely contacted therewith, so that the contact area between the core and the wire connecting portion is widened. Therefore, the electric resistance of the portion in which the terminal and the wire are connected to each other is lowered, and the power transmission efficiency is raised, so that a current of a higher voltage can be flown through the terminal. In order to attain the same contact area with respect to the core as that in an existing circumferential crimp connection terminal, the length of the wire connecting portion can be shortened by a degree corresponding to the surface area of the contact protrusion. Therefore, miniaturization of the terminal in the longitudinal direction is enabled. Since the core is clampingly held in the annular space between the wire connecting portion and the contact protrusion, the wire fixing force is increased, so that, even when a strong pulling force is applied to the wire, slipping-off of the core from the wire connecting portion does not occur. Therefore, the reliability of the electrical connection is improved.

When the wire connecting portion is crimped by the circumferential crimping unit, the contact protrusion is pressed uniformly over the whole circumference via the core, and the contact protrusion is closely contacted with the element wires of the core without forming a gap therebetween. Therefore, the contact protrusion is not forcible deformed, or the element wires are not broken, so that the reliability of the electrical connection can be enhanced.

The center of the element wires of the core, that of the contact protrusion, and contacts between the element wires and the contact protrusion are on the same straight line, and the element wires are closely contacted with the contact protrusion by a radial force which is uniform over the whole circumference. Therefore, the reliability of the electrical connection is enhanced.

When the core is inserted into wire insertion hole, the contact protrusion smoothly enters the core through the element wires. Therefore, the connecting work can be simplified. When the wire connecting portion is subjected to a circumferential crimping process, the contact protrusion is radially pressed by the element wires to be axially elongated together with the wire connecting portion, and finally has a length which is about one half of the initial length of the wire insertion hole. As a result, a sufficient contact length with the core is ensured. Therefore, the electrical contact performance and the wire retaining strength are ensured.

What is claimed is:

1. A terminal comprising:

a wire connecting portion including a wire insertion hole, the wire connecting portion to be subjected to a circumferential crimping process; and a contact protrusion, for entering a core of a wire, elongating in a longitudinal direction of a wire and disposed in the wire insertion hole, wherein the contact protrusion has an initial length which is substantially one third of a length of the wire insertion hole.

2. The terminal according to claim 1, wherein the contact protrusion is positioned at a center of the wire insertion hole.

3. The terminal according to claim 1, wherein the contact protrusion has a columnar shape.

* * * * *